United States Patent [19]

Potgieter

[11] 4,270,827

[45] Jun. 2, 1981

[54] BATTERY CABLE CONNECTOR

[76] Inventor: Maurice S. Potgieter, 8122 E. 65th St., Tulsa, Okla. 74133

[21] Appl. No.: 18,236

[22] Filed: Mar. 7, 1979

[30] Foreign Application Priority Data

Mar. 9, 1978 [DE] Fed. Rep. of Germany ... 7807069[U]

[51] Int. Cl.[3] ..... H01R 4/54; H01R 11/20; H01R 11/24

[52] U.S. Cl. ..... 339/95 B; 339/100; 339/101; 339/228

[58] Field of Search ..... 339/95 B, 100, 101, 339/224, 228, 90 R; 174/135; 277/212 FB

[56] References Cited

U.S. PATENT DOCUMENTS

| | | | |
|---|---|---|---|
| 243,162 | 6/1881 | Sawyer | 339/101 |
| 2,795,641 | 6/1957 | Rowell | 339/101 X |
| 3,136,592 | 6/1964 | Miller | 339/90 R X |
| 3,395,244 | 7/1968 | Koehler | 339/101 X |
| 3,662,322 | 5/1972 | Morrison | 339/128 X |
| 4,146,288 | 3/1979 | Ramsay et al. | 339/90 R |

FOREIGN PATENT DOCUMENTS

| | | | |
|---|---|---|---|
| 2520651 | 11/1975 | Fed. Rep. of Germany | 339/100 |

*Primary Examiner*—John McQuade
*Assistant Examiner*—John S. Brown
*Attorney, Agent, or Firm*—Stevens, Davis, Miller & Mosher

[57] ABSTRACT

This invention relates to a battery terminal particularly for batteries commonly used in motor vehicles and having terminals in the form of cylindrical lugs; more particularly the battery terminal is of the type having a cap which fits over a battery lug and has a slideable contact piece therein which is spring biased toward the lug and is connected to an electrical cable.

5 Claims, 2 Drawing Figures

BATTERY CABLE CONNECTOR

Figure 1:
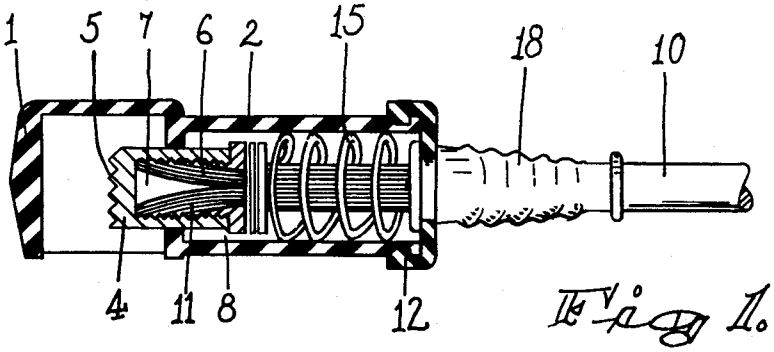

The invention concerns a battery connecting terminal, particularly for batteries of the type used in motor vehicles, the terminals of which are substantially in the form of cylindrical connecting lugs. The invention concerns in particular a battery connecting terminal of that kind which consists of:

- a cap which is made from electrically-insulating material, fits onto a battery lug and is closed on one side;
- a sleeve-like extension fitted to the cap in the radial direction and having its interior cavity connected through an aperture to the interior cavity of the cap;
- a contact piece which is fitted in the interior of the sleeve-like extension in the radial direction of the cap and which with its frontal side, formed preferably as a toothed contact surface, can be pushed through the aperture into the cap, and which is provided at its rear end with a cable-terminal clamping arrangement;
- a closure lid which can be applied firmly to that end of the extension piece which is remote from the cap and which is provided with an opening for the passage of a cable;
- a compression spring which is fitted inside the extension piece, is supported at its one end against the closure lid, and with its other end presses the contact piece through the aperture.

A battery terminal of this type is described in U.S. Pat. No. 3,662,322. The known battery terminal has several disadvantages from the handling point of view. For example it is difficult to connect the above-described terminal to the associated cable without special tools, so that such a connection can in general only be effected during the manufacture of the cable, and the terminal cannot as required just be applied by anybody to a given cable. What is a hindrance in this connection is on the one hand the manner in which the cable-terminal arrangement is made at the contact piece, it being necessary for a metal sleeve to be guided over an extension of the contact piece and the insulated end of the cable to be connected, and to be clamped fast to those parts by permanent deformation. On the other hand it is difficult to engage the closure lid which is made out of a plastic material in the groove at the end of the sleeve-like extension, and still more difficult to remove the lid again. In general it is necessary to heat the lid for that purpose.

A further disadvantage of the known battery-connecting terminal is that for starting the engine by means of an outside source of current when the battery is flat a cable provided with the known terminal must first be removed from the battery before the outside cable can be connected up.

It is the purpose of the invention to create a battery-connecting terminal of the type described in the foregoing which permits of self-assembly by anyone and further makes it possible to connect up temporarily the cable terminals of an outside starter battery without having to remove the battery connection terminals from the disabled vehicle.

That purpose is achieved, according to the invention, in that the cable-attaching arrangement comprises a blind hole formed in the rear end of the contact piece and provided with an internal thread, a conical element made of electrically conducting material and having its base supported against the terminal surface of the blind hole, and a clamping sleeve made of electrically conducting material and provided with an external thread which can be screwed into the blind hole until its frontal edge comes up against the jacket of the conical element. The invention is further characterised in that the closure lid can be connected with the end of the sleeve-like extension piece by means of a bayonet connection fitted to both parts, and in that the closure lid is, by widening of the opening for the passage of the cable, provided with an elastic socket for introduction of the cable. Some further developments of the new battery connection terminal are made the subjects of the sub-claims.

Figure 2:
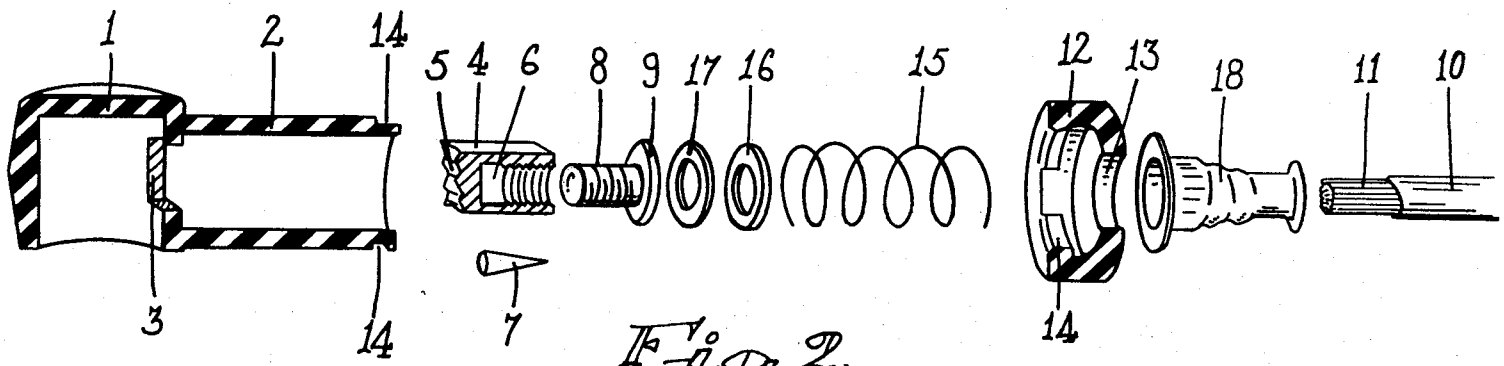

The advantages of the new arrangement (according to the invention) are in what follows explained in greater detail by reference to the illustration of a preferred example of embodiment and by reference to the attached drawings in which:

FIG. 1 shows a longitudinal section through a preferred embodiment of a battery-connecting terminal according to the invention, and FIG. 2 shows a view in perspective of a battery-connecting terminal according to FIG. 1 exploded into its separate parts.

The new battery-connecting terminal consists of a cap 1 made of electrically insulating material and closed on one side. The cap is so dimensioned that it fits on to the connecting lug of the battery to which it is to be connected. Since, for the avoidance of confusion of the two cables, batteries are in general provided with two lugs of different diameters, it is also necessary to provide battery-connecting terminals of the type described with caps 1 of different diameters. The caps are with advantage so formed that their internal diameter is somewhat larger than the external diameter of the associated battery lug, so that there is a certain amount of play between the cap 1 and the lug. To the cap in the direction of its radius there is connected a sleeve-like extension 2 like-wise made of electrically insulating material and preferably made or cast in one piece with the cap 1. The interior of the sleeve-like extension 2 is connected to the interior of the cap 1 through an aperture 3.

Inside the sleeve-like extension 2 is fitted a contact element 4 which is made of electrically conducting material and the frontal end of which, to be brought into contact with the lug of the battery, is pushed from the side through the aperture 3 into the interior of the cap 1.

The frontal end of the contact element 4 is advantageously provided with a toothed profile 5 or the like, the teeth of which easily work their way into the lug of the battery under pressure for giving better contact in that they penetrate through any layers of dirt or grease which may have become deposited on the lug. The toothed profile 5 runs with advantage on into a curvature matching the periphery of the lug in order to give a greater contact surface. In order that for this purpose the front side of the contact element 4 may always remain in correct alignment, the element 4 and the aperture 3 are not made round but given some other cross-sectional profile so that the element 4 cannot turn inside the aperture 3. In the embodiment illustrated in the drawings a rectangular cross-section has been chosen.

At its rear end the contact element 4 is provided with a terminal clamping device for the associated battery-connecting cable. That clamping device consists, in detail, of a blind hole 6 drilled into the rear end of the contact element and provided with an internal thread. The conical element 7 is so arranged that its base comes up against the floor of the blind hole 6. The element 7 could be made in one piece with the contact element 4, but for technical manufacturing reasons it is more advantageous to make the element as a separate structural part. It can be attached to, or merely laid loosely up against, the floor of the blind hole 6. The clamping bush 8 is provided in order to be screwed into the blind hole 6. When, however, the conical element 7 has been inserted, such screwing in is only possible until the front edge of the bush 8 comes up against the surface of the element 7. To make screwing in of the bush by hand easier the latter is with advantage provided with a flange-like head 9 through which likewise the internal bore of the bush 8 passes. It is advantageous for the head 9 to be knurled.

Fastening the supply cable in this new cable-clamping device is, as can be imagined, easy. The end of the cable 10 is uninsulated and the clamping bush 8 is pushed over this end of the cable. The conical element 7 is then inserted in the blind hole 6, and the uninsulated cable end 11, which consists of a number of individual stranded wires, is introduced into the hole 6, the tip of the conical element 7 penetrating between the insulated wires of the cable end 11 and spreading them out on all sides along its surface. Finally the clamping bush 8 is screwed into the blind hole 6 until its front edge comes to press firmly against the stranded wires of the cable which are lying against the conical element 7. The resulting wedge effect causes the cable to be firmly clamped into position.

The free end of the sleeve-like extension 2 can be closed up by a lid 12 which has a hole 13 for the passage of the cable 10. The lid or cover 12 is attached to the rear end of the extension piece 2 by means of a bayonet closure 14. Inside the extension 2 are also a compression spring 15, an insulating disc 16 and a metal disc 17. The compression spring 15 is supported on the one side against the inner side of the cover 12, while it presses with its other end through the insulating disc 16 and the metal disc 17, the contact piece 4 in the direction through the aperture 3.

Finally the lid 12 is provided with a cable-introducing socket 18. This extends in the usual manner through the cable passage 13 in the lid 12 and grips in behind the inner side of that lid in the manner of a flange so that it may be secured against a loosening of the lid. The cable-introducing socket is so formed that its rear end does not grip the cable 10 too tightly and can be pushed together elastically in the direction of the lid 12.

The method of operation of the new battery-clamping terminal is as follows:

The fastening of the insulated end 11 of the cable 10 in the contact element 4 has already been described. When the lid 12 has been taken off, the cable 10, with the contact element 4 attached to it, is pushed from behind into the sleeve-like extension piece 2. The projection of the frontal end 5 of the contact element 4 through the aperture 3 can if necessary be limited by means of a flange or a band on the contact element 4 or on the clamping bush 8. Now, from behind the metal disc, the insulating disc and the compression spring 15 are pushed on to the cable, and the lid 12 with the cable-introducing socket 18 which has also been pushed over the cable 10 is locked, against the pressure of the spring 15, to the rear end of the sleeve-like extension piece 2.

For attachment of the battery-connecting terminal to the lug of the battery all that is necessary is to pull the cable 10 backwards in order to draw the contact element 4, against the pressure of the spring 15, so far back into the sleeve-like extension 2 that the cap 1 can be freely fitted over the battery lug. The cable 10 is then left free so that the compression spring 15 now presses the contact element 4 with its toothed profile 5 against the lug. The removal of the battery-connecting terminal from the battery lug is effected correspondingly.

In the course of assembly the end of the cable 10 conveniently has the insulation removed from its end over such a distance that the end of the insulation just protrudes into the cable-insertion socket 18. If it is desired temporarily to clamp a further cable to the battery, all that is necessary is to push the socket 18 towards the lid 12 and to clamp the further cable on to the insulated area 11 of the cable 10. This procedure renders it unnecessary, when starting is being effected by means of an outside current source, to remove the battery's own cable which has been provided with the new battery-connecting terminal. It is also possible, for checking and testing purposes, in a simple manner to connect up a branch cable temporarily.

What I claim as new and desire to secure by Letters Patent is:

1. A battery cable connector for motor vehicle batteries having substantially cylindrical connecting lugs comprising, a cap of electrically insulating material for the lug, a radial sleeve-like extension piece projecting from the cap in communication through a noncircular aperture with the interior of the cap, an electrical contact piece of complementary shape to the aperture and having a toothed contact surface for engagement with the lug, a blind threaded hole in the end of the contact piece opposite the contact surface, an electrically conductive conical element with its base supported by the bottom of the blind hole, an electrically conductive clamping sleeve screw threaded into the blind hole, an easily detachable closure lid for the end of the extension piece remote from the cap, said lid having an opening for the cable, bayonet joint formations between the extension piece and the lid, a compression spring located between the lid and the contact piece, and an elastically longitudinally compressible socket extending outwardly from the lid to extend over the cable, said socket being so formed that its end distal from the lid does not grip the cable too tightly so that the socket can be pushed together elastically in the direction of the lid.

2. A battery-connecting terminal as claimed in claim 1 in which the clamping sleeve has at its outer end a head-like annular element for facilitating screwing in by hand.

3. A battery-connecting terminal as claimed in claim 1 in which the closure lid is made of electrically-insulating material.

4. A battery-connecting terminal as claimed in claim 1 in which the elastic socket is inserted loosely through the closure lid opening and has an annular flange which is seated adjacent the inner surface of the side of the closure lid.

5. A battery-connecting clamp as claimed in claim 1 in which the conical element is inserted loosely in the blind hole.

* * * * *